US005641924A

United States Patent [19]

Hsieh

[11] Patent Number: 5,641,924

[45] Date of Patent: Jun. 24, 1997

[54] PEDAL FOR BASS DRUM

[76] Inventor: Wu Hong Hsieh, No. 162, Chungshan 2nd Rd. Luchou Hsiang, Taipei Hsien, Taiwan

[21] Appl. No.: 659,271

[22] Filed: Jun. 6, 1996

[51] Int. Cl.[6] ..... G10D 13/02

[52] U.S. Cl. ..... 84/422.1

[58] Field of Search ..... 84/422.1, 422.2

[56] References Cited

U.S. PATENT DOCUMENTS 2,446,508 8/1948 Crowell ..... 84/422.1

*Primary Examiner*—Michael L. Gellner
*Assistant Examiner*—Shih-yung Hsieh
*Attorney, Agent, or Firm*—Thomas, Kayden, Horstemeyer & Risley

[57] ABSTRACT

A clamping mechanism of a pedal for firmly attaching the pedal to a counterhoop of a bass drum consists of a frame defining a counterhoop receiving seat and a pair of upright walls, a clamping plate pivotally mounted on the upright walls, a clamping force generating means mounted on a rear end of the pressing plate, a clamping block defining a protruding ridge on its top face and movably mounted a bottom of a front portion of the pressing plate.

6 Claims, 5 Drawing Sheets

PEDAL FOR BASS DRUM

FIELD OF THE INVENTION

The present invention is related to an improved pedal for a base drum, particularly to an improved clamping mechanism for attaching the pedal to the drum.

BACKGROUND OF THE INVENTION

A bass drum is very a popular music instrument for producing extreme percussive bass sound. FIG. 4 shows a conventional pedal 10 for a bass drum (not shown). The pedal 10 comprises a foot plate 12 which has an end pivotably mounted on a base of the pedal 10 and another end pivotably connected with a linkage 14, a mounting block 16 which defines a socket 162 for receiving an end of a beater (not shown) which is drivably connected with the linkage 14 through a shaft 18 which is used to rotatably support the mounting block 16 on a bearing means. When the foot plate 12 is stepped on by a foot of a user, the mounting block 16 will have a pivotable movement with the shaft 18 about the bearing means to make the beater strike on a head (not shown) of the drum to generate bass sound.

Furthermore, the conventional pedal 10 comprises a clamping mechanism generally indicated by reference number 20 to attach the pedal 10 to a counterhoop 60 (FIGS. 6 and 7) of the bass drum.

Also referring to FIG. 5, the clamping mechanism 20 comprises a frame 30 defining a counterhoop receiving seat 32 and two upright walls 34 spacing from each other a distance. Each wall 34 defining a hole 342 to allow a pin 48 to extend therethrough. A pressing plate 40 is pivotably mounted on the pin 48 by extending the pin 48 through a hole 401 horizontally defined in the pressing plate 40 and the holes 342 of the upright walls 34. A clamping block 50 is fixedly mounted on a bottom of the pressing plate 40 and located near a front end thereof by extending a screw 42 through a countersink 402 vertically defined in the pressing plate 40 to threadedly and fixedly engage in a periphery defining a hole 502 in the clamping block 50. A bolt 44 which has a handle 46 fixedly connected therewith is threadedly connected with the pressing plate 40 on a rear end thereof. When the handle 46 is turned to rotate the bolt 44 about the pressing plate 40 to lift the rear end of the pressing plate 40 along the bolt 44, the front portion of the pressing plate 40 and, thus, the clamping block 50 will have a downward movement since the pressing plate 40 is pivotably mounted on the upright walls 34 via the pin 48. Thus, the clamping block 50 can exert a clamping force on the counterhoop 60 (FIGS. 6 and 7) of the bass drum to attach the pedal 10 to the bass drum.

However, the clamping mechanism 20 of the conventional pedal 10 has the following disadvantages, which will be explained in detail in reference to FIGS. 6 and 7.

Generally, the thickness of the counterhoop of a bass drum is ranged from 9 mm to 10 mm. When the counterhoop 60 which has a large thickness, for example 10 mm as shown in FIG. 6, is pressed between the receiving seat 32 and the clamping block 50, due to the clamping block 50 being fixedly attached on the pressing plate 40 and the geometry relationship between the counterhoop 60 and the clamping block 50, only a rear portion of the clamping block 50 can effectively engage with the counterhoop 60. Alternatively, when the counterhoop 60, which has a small thickness, for example 9 mm as shown in FIG. 7, is pressed between the receiving seat 32 and the clamping block 50, based on the same reasons as mentioned above, only a front portion of the clamping block 50 can effectively engage with the counterhoop 60. In both of the above two situations, the clamping mechanism 20 can not very firmly clamp the counterhoop 60, so that after a period that the beater has struck on the head of the drum, the pedal 10 may detach from the bass drum.

SUMMARY OF THE INVENTION

It is an objective of the present invention to provide a pedal for a bass drum which has an improved clamping mechanism able to very firmly clamp the counterhoop of a bass drum thereby to firmly attach the pedal to the bass drum.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
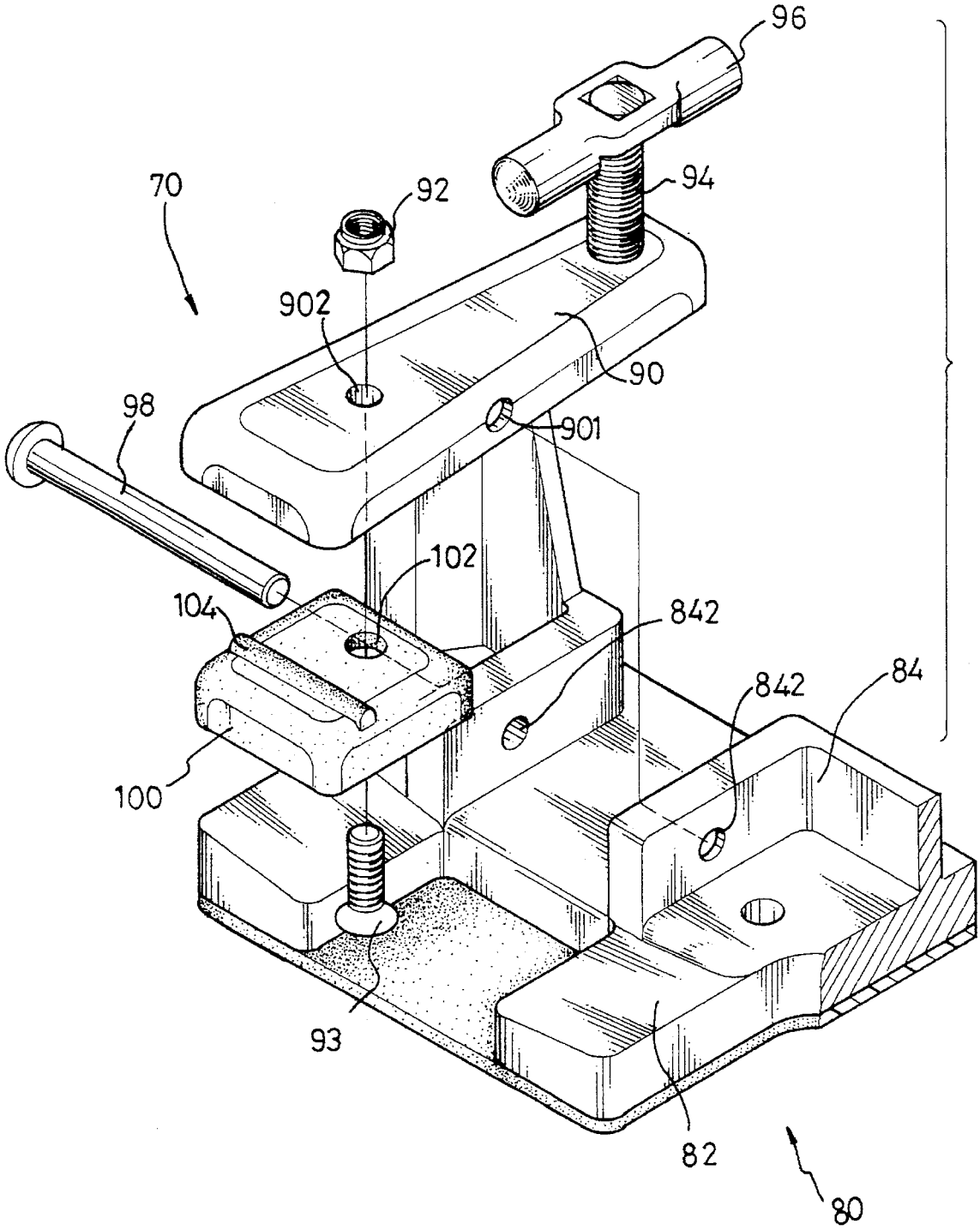
FIG. 1 is an exploded and partly cutaway perspective view showing a clamping mechanism of a pedal for a bass drum in accordance with the present invention.
Figure 4:
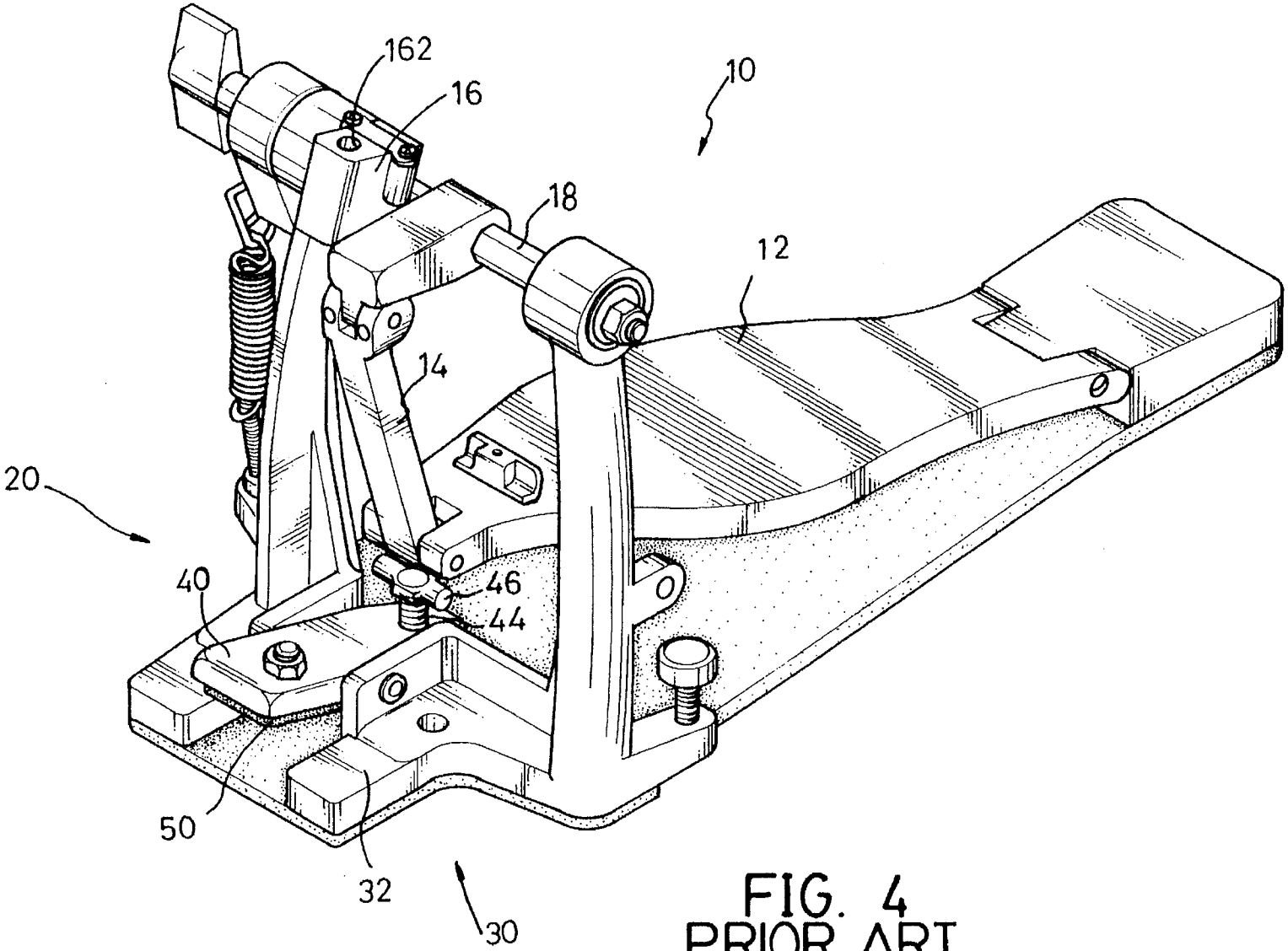
FIG. 4 PRIOR ART
FIG. 4 is a perspective view showing a pedal for a bass drum.
Figure 5:
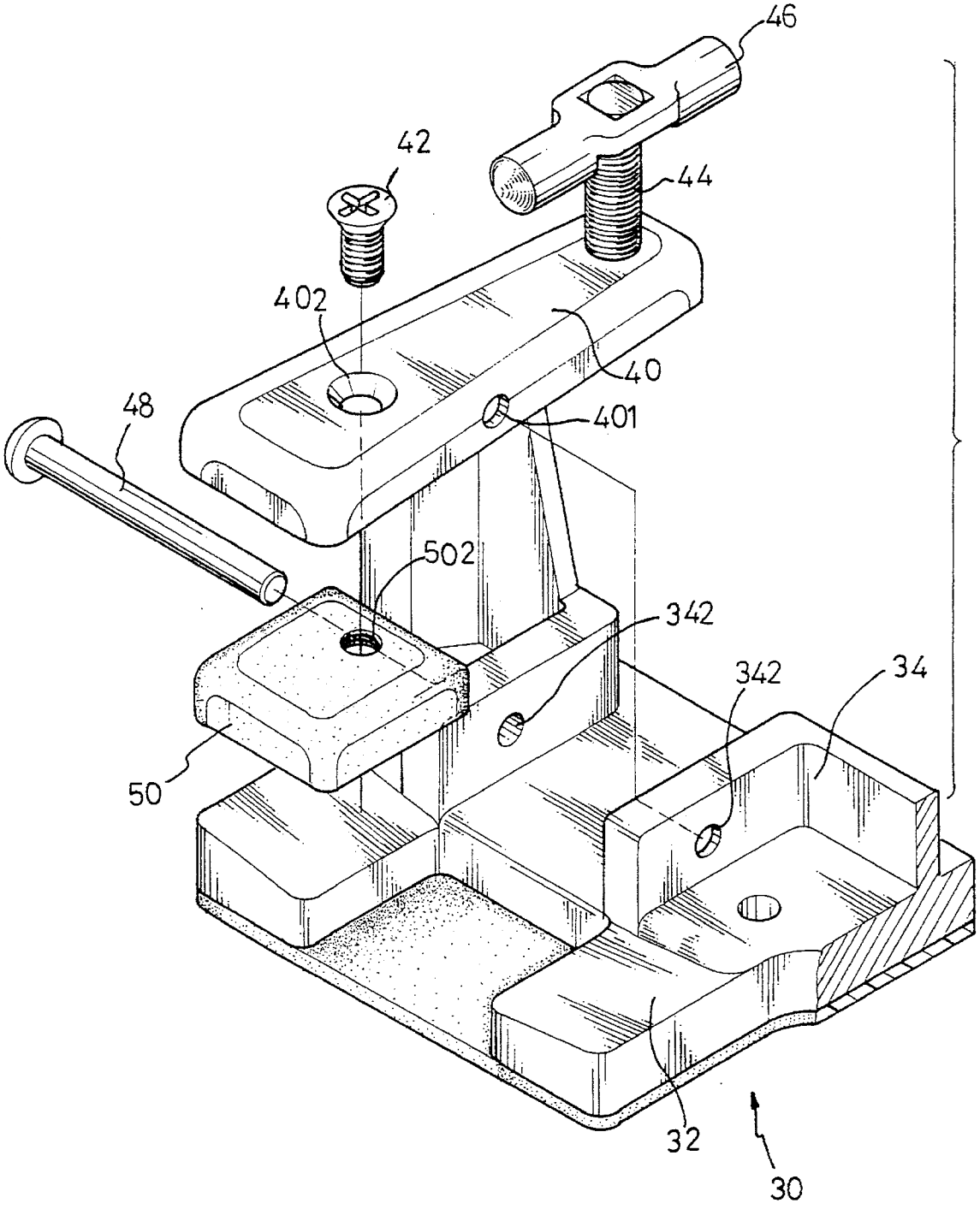
FIG. 5 PRIOR ART
FIG. 5 is an exploded and partly cutaway perspective view showing a prior art clamping mechanism.
Figure 6:
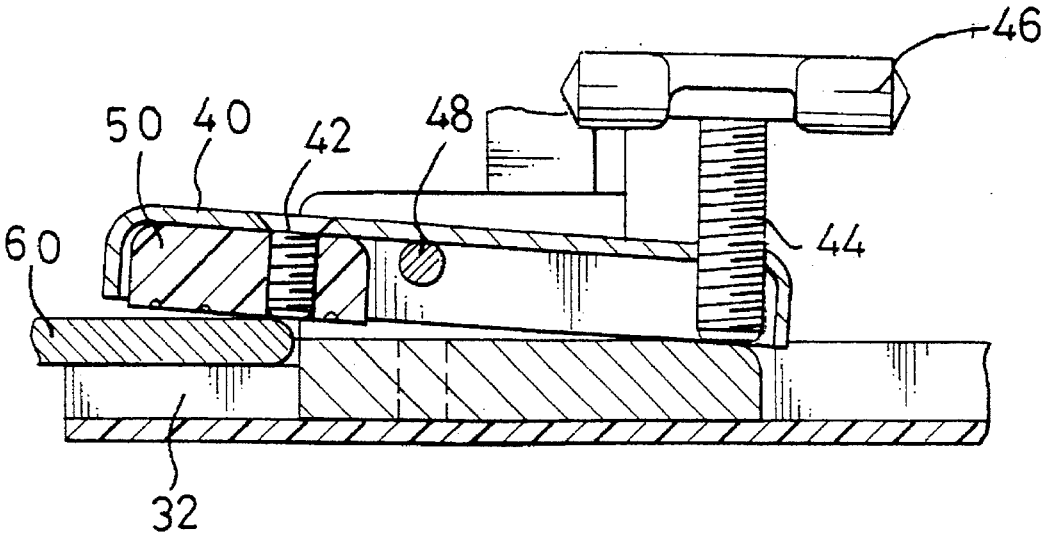
FIG. 6 PRIOR ART
FIG. 6 is a cross-sectional view showing that the prior art clamping mechanism of FIG. 5 is used to clamp a counterhoop having a large thickness.
Figure 7:
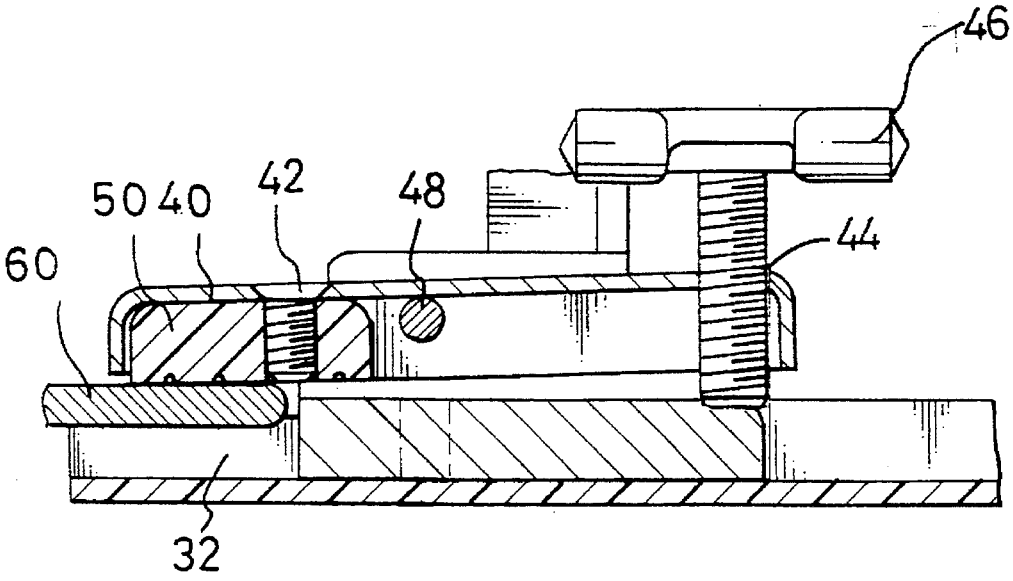
FIG. 7 PRIOR ART
FIG. 7 is a view similar to FIG. 6, but showing that the prior art clamping mechanism is used to clamp a counterhoop having a small thickness.

Referring to FIG. 1, which shows a clamping mechanism 70 of a pedal in accordance with the present invention. The pedal is used for a bass drum. Since the portion of the pedal for pivoting a beater to strike a head of the bass drum, which includes the parts of a foot pedal, a linkage, a beater mounting block and a shaft, etc. is the same as that of the conventional pedal 10 as shown in FIG. 4, this portion is cut away from FIG. 1 and a repeated disclosure thereabout is omitted.

The clamping mechanism 70 of the present pedal, like the conventional clamping mechanism, also consists of a frame 80 defining a counterhoop receiving seat 82 and two upright walls 84 spacing from each other a distance. Each wall 84 defines a hole 842 to allow a pin 98 to extend therethrough. A pressing plate 90 is pivotably mounted on the pin 98 by extending the pin 98 through a hole 901 horizontally defined in the pressing plate 90 and the holes 842 defined in the upright walls 84. Also, the present clamping mechanism 70 comprises a bolt 94 which has a handle 96 fixedly connected therewith. The bolt 94 is threadedly connected with the pressing plate 90 on a rear portion thereof. When the handle 96 is turned to rotate the bolt 94 about the pressing plate 90 to lift the rear portion of the pressing plate 90 along the bolt 94, a front portion of the pressing plate 90 and a clamping block 100 which is movably mounted on a bottom of the front portion of the pressing plate 90 will have a downward movement about the pin 98.

The clamping block 100 of the present clamping mechanism 70 has a structure different from that of the conventional clamping mechanism and is connected to the clamping plate 90 in a manner different from that of the conventional clamping mechanism whereby the clamping block 100 can have an effective area as large as possible to engage with a counterhoop 110 (FIGS. 2 and 3), no matter whether the clamping block 100 is engaged with the counterhoop 110 having a large or small thickness.

Figure 2:
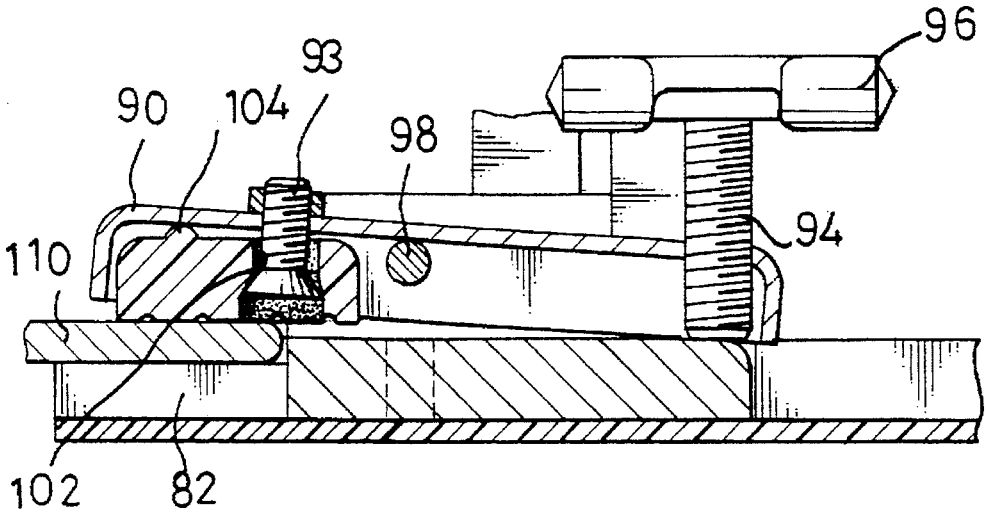
FIG. 2 is a cross-sectional view showing that the claiming mechanism of FIG. 1 is used to clamp a counterhoop having a large thickness.
Figure 3:
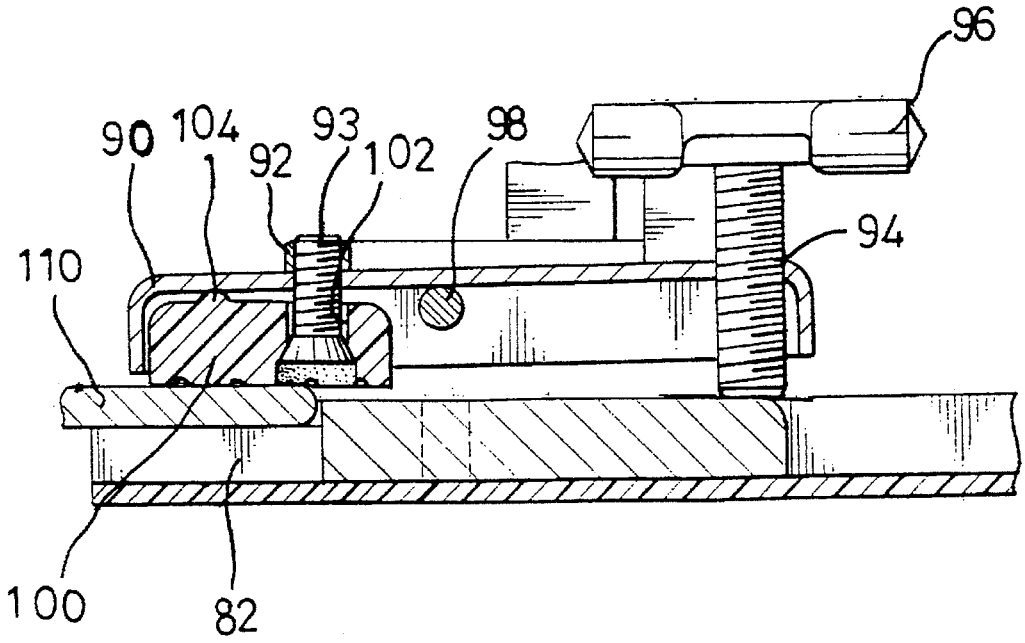
FIG. 3 is view similar to FIG. 2, but showing that the clamping mechanism is used to clamp a counterhoop having a small thickness.

Also referring to FIGS. 2 and 3, the clamping block 100 is formed to have a protruding ridge 104 extending laterally across a top face of the clamping block 100. A hole 102 is vertically defined in the clamping block 100 and is defined by a smooth periphery. The hole 102 is generally divided into three portions: an upper portion with a small diameter, a lower portion with a large diameter and a transition portion therebetween with a taper. A hole 902 is vertically defined in the pressing plate 90 and a periphery thereof defines a thread. The clamping block 100 is mounted on a bottom of the pressing plate 90 near the front portion thereof by extending a screw 93 through the hole 102 to be threadedly received in the hole 902 and engage with a nut 92. The nut 92 is used to ensure that the screw 93 can be firmly fixed in position in which the clamping block 100 may have a limited movement in relation to the pressing plate 90, since the clamping block 100 is not fixedly engaged with the screw 93. However, the clamping block 100 will not work loose from the pressing plate 90 since a head of the screw 93 will fit with the transition portion of the hole 102.

In the present invention, the clamping block 100 can have a limited movement in relation to the pressing plate 90, and the pressing plate 90 exerts a pressing force to the clamping block 100 through the ridge 104, which is defined on the top of the clamping block 100 and so positioned that the distances between it and a front edge of the clamping block 100 and between it and the hole 102 are generally the same, wherein the distance between the front edge of the clamping block 100 and the hole 102 defines an effective length that the clamping block 100 can engage the counterhoop 110. By such a design, no matter whether the counterhoop 110 to be clamped by the present invention has a large thickness (as that shown in FIG. 2) or a small thickness (as that shown in FIG. 3), when the handle 96 is turned to exert a clamping force on the clamping block 100 through the pressing plate 90, the clamping block 100 can always substantially horizontally engage the counterhoop 110 so that the clamping block 100 can have an effective area as large as possible to engage the counterhoop 110. Thus, the counterhoop 110 can be very firmly clamped by the present invention thereby to firmly attach the pedal to the bass drum.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A clamping mechanism of a pedal for attaching the pedal to a counterhoop of a bass drum, comprising:

a frame defining a receiving seat adapted to receive a counterhoop to be clamped and an upright wall;

a pressing plate pivotably mounted on the upright wall to divide the pressing plate into a first portion located above the receiving seat and a second portion;

a clamping block defining a protrusion on a top face thereof;

a clamping force generating means provided on the second portion of the clamping plate and used to generate a clamping force on the clamping block; and mounting means positioned between the protrusion and the clamping force generating means and used to mount the clamping block to a bottom of the first portion of the pressing plate in which the clamping block may have a limited movement in relation to the pressing plate.

2. The clamping mechanism in accordance with claim 1, wherein the protrusion is a ridge extending laterally across the top face of the clamping block.

3. The clamping mechanism in accordance with claim 1, wherein the mounting means comprises a screw, a first hole defined in the clamping block, a second hole defined by a threaded periphery in the pressing plate and wherein the screw is extended through the first hole to be threadedly received in the second hole.

4. The clamping mechanism in accordance with claim 3, wherein the mounting means further comprises a nut threadedly engaging with the screw.

5. The clamping mechanism in accordance with claim 4, wherein the nut is positioned on a top of the pressing plate when it is threadedly engaged with the screw.

6. The clamping mechanism in accordance with claim 1, wherein the clamping force generating means comprises a threaded bolt threadedly engaging the pressing plate and a handle fixedly connected with the threaded bolt.

* * * * *